US006371630B1

(12) United States Patent
Unger

(10) Patent No.: US 6,371,630 B1
(45) Date of Patent: Apr. 16, 2002

(54) LUMINAIRE CONFIGURATION HAVING LUMINAIRE AND MOUNTING MODULES ATTACHABLE AND DETACHABLE WITHOUT DISTURBING ILLUMINATION PRODUCING COMPONENTS

(75) Inventor: Helmuth K. Unger, Menden (DE)

(73) Assignee: Wila Leuchten AG, Sevelen (CH)

( * ) Notice: Subject to any disclaimer, the term of this patent is extended or adjusted under 35 U.S.C. 154(b) by 0 days.

(21) Appl. No.: 09/520,773

(22) Filed: Mar. 8, 2000

(30) Foreign Application Priority Data

Mar. 10, 1999 (DE) ..... 199 10 469

(51) Int. Cl.[7] ..... F21V 19/00
(52) U.S. Cl. ..... 362/365; 362/148; 362/226
(58) Field of Search ..... 362/147, 148, 362/226, 404, 365, 368, 370

(56) References Cited

U.S. PATENT DOCUMENTS

| | | | | |
|---|---|---|---|---|
| 4,475,147 A | * | 10/1984 | Kristofek | 362/148 |
| 4,976,633 A | * | 12/1990 | Beghelli | 362/404 |
| 4,980,808 A | * | 12/1990 | Lilos | 362/404 |
| 6,000,818 A | * | 12/1999 | Caluori | 362/147 |
| 6,095,660 A | * | 8/2000 | Moriyama et al. | 362/148 |
| 6,132,069 A | * | 10/2000 | Sato et al. | 362/226 |
| 6,174,076 B1 | * | 1/2001 | Petrakis et al. | 362/148 |

FOREIGN PATENT DOCUMENTS

| | | |
|---|---|---|
| DE | 9017372.4 U | 5/1991 |
| DE | 19543972 A1 | 5/1997 |
| DE | 29718829 U1 | 3/1998 |
| WO | WO 92/95389 | 4/1992 |

* cited by examiner

*Primary Examiner*—Sandra O'Shea
*Assistant Examiner*—Peggy A Neils
(74) *Attorney, Agent, or Firm*—Flanagan & Flanagan; John R. Flanagan

(57) ABSTRACT

A luminaire configuration includes a mounting module attachable on a securement base, such as the building ceiling or wall, a luminaire module adapted to support illumination producing components, and a connection system having first and second connection elements by which the luminaire module is attachable to and detachable from the mounting module through mechanical cooperation between the first and second connection elements without disturbing the illumination producing components. The luminaire module includes a luminaire housing having an annular shape and a coupling ring fitted thereto. The luminaire housing supports the illumination producing components therein. The attachment and detachment of the luminaire module to and from the mounting module is achieved by the first connection element provided on the mounting module being insertable into and withdrawable from a releasable engagement with the second connection element provided on the coupling ring of the luminaire module such that the luminaire module is thereby fastened on the mounting module through a releasable latch-type engagement between the first and second connection elements.

6 Claims, 4 Drawing Sheets

Fig. 1a
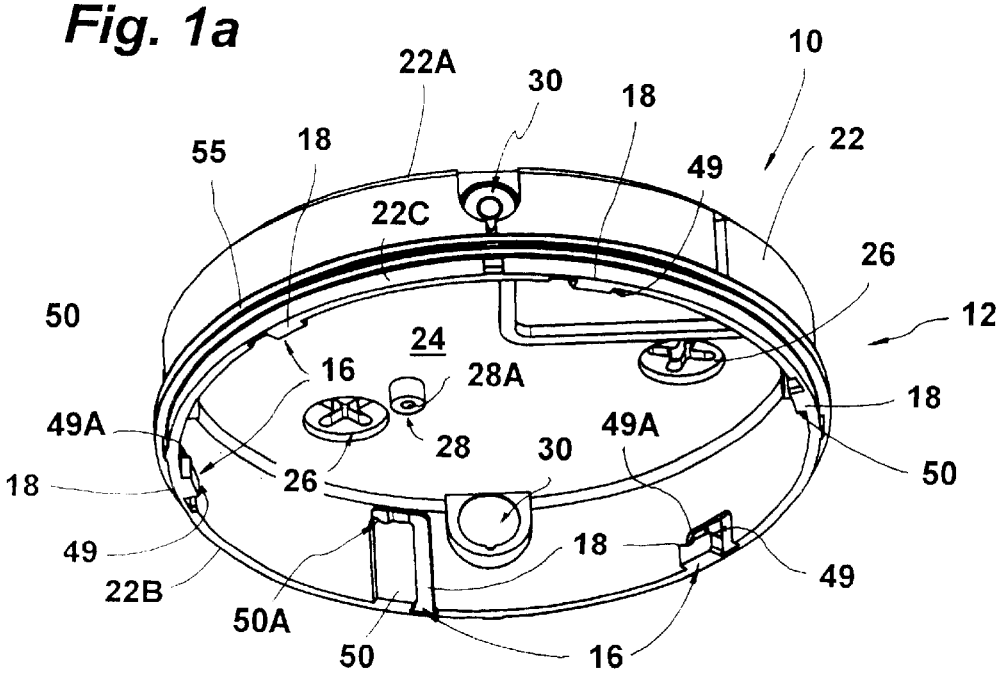
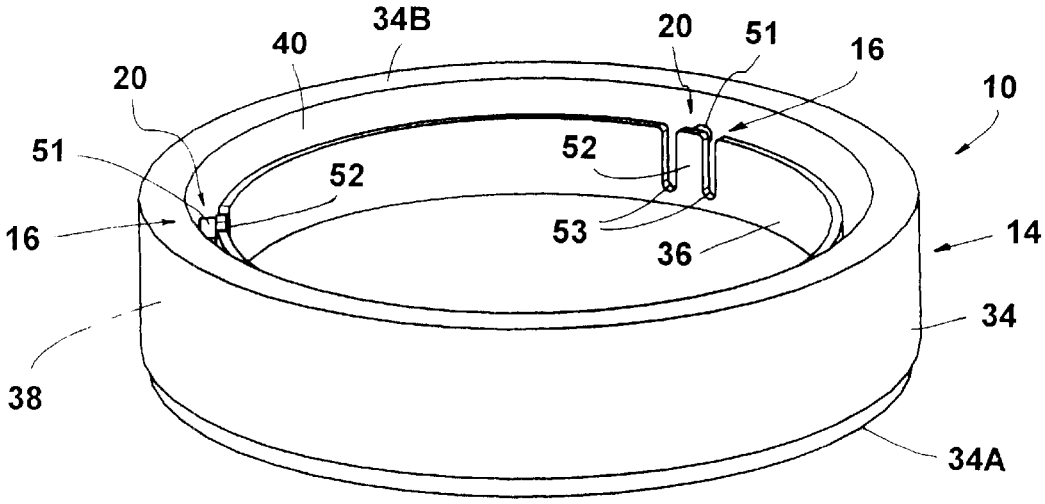
Fig. 1b

LUMINAIRE CONFIGURATION HAVING LUMINAIRE AND MOUNTING MODULES ATTACHABLE AND DETACHABLE WITHOUT DISTURBING ILLUMINATION PRODUCING COMPONENTS

BACKGROUND OF THE INVENTION

1. Field of the Invention

The present invention relates to a luminaire mountable on a securement base, for example a building ceiling or a wall, and more particularly is concerned with a luminaire configuration having a mounting module attachable on the securement base, a luminaire module supporting illumination producing components, and a connection system by which the luminaire module is attachable to and detachable from the mounting module without disturbing the illumination producing components.

2. Description of the Prior Art

Luminaires mountable on a securement base, for example a building ceiling or a wall, are well-known. One such ceiling luminaire comprises a housing in which illumination producing components of the luminaire, such as a reflector, lamp bulb and other necessary devices, are disposed. On its side facing the securement base, the luminaire housing is closed with a mounting cover. In the mounting cover are provided cable entries as well as fastening openings, with the fastening openings serving for fastening the mounting cover on the securement base, such as the building ceiling or wall, by using screws.

The luminaire housing can be fastened to the mounting cover, for example, by using set screws that radially penetrate an outer wall of the luminaire housing. However, this has the disadvantage that the set screws are visible from the outside. In order to deal with this disadvantage other ceiling luminaires are known in which the connection of the luminaire housing with the mounting cover closing the luminaire housing on the fastening side is brought about by using fastening screws which are disposed within the luminaire housing parallel to a longitudinal axis of such a ceiling luminaire.

Thus, it is advantageous that no fastening means can be seen from the outside of the luminaire after the luminaire is mounted. However, in order to access the fastening screws for mounting such a ceiling luminaire, it is necessary to remove the illumination producing components of the ceiling luminaires for example a front covering glass, reflector and lamp, and occasionally including a lamp socket, from the luminaire housing. For this reason, the mounting of such a ceiling luminaire is time consuming and expensive in view that the luminaire must first be disassembled and, after the mounting of the mounting cover on the ceiling side is completed, the luminaire must again be completely assembled. Since in mounting such a luminaire the electrical connections are already established, such mounting must be carried out exclusively by trained technical personnel, for example electricians.

Consequently, there is a need for a luminaire configuration which is mountable with considerably lower expenditures and is provided with components that can be mounted by untrained persons.

SUMMARY OF THE INVENTION

The present invention overcomes the aforementioned problems by providing a luminaire configuration which includes a mounting module attachable on a securement base, such as the building ceiling or wall, a luminaire module supporting illumination producing components, and a connection system having first and second connection elements by which the luminaire module is attachable to and detachable from the mounting module through mechanical cooperation between the first and second connection elements without disturbing the illumination producing components. The luminaire module includes an outer luminaire housing having an annular shape and a coupling ring fitted thereto. The outer luminaire housing supports the illumination producing components therein. The attachment of the luminaire module with the mounting module is achieved by the first connection element provided on the mounting module being insertable into and removable from releasable engagement with the second connection element provided on the coupling ring of the luminaire module such that the luminaire module is thereby fastenable on the mounting module through a releasable latch-type engagement between the first and second connection elements. This attachment and detachment of the luminaire module to and from the mounting module takes place via a movement of the luminaire module relative to the mounting module that is effected without additional tools being required. The latch-type cooperation between the first and second connection elements leads to a form-fit connection that can take place without a significant expenditure of energy being necessary. The luminaire configuration according to the present invention is thus constructed modularly and its luminaire module at a rear side has only a joining cable piece projecting therefrom. An electrical plug can be applied on the end of the cable piece to facilitate handling and connection of the luminaire module to the mounting module by inexperienced or untrained persons.

The advantage resulting from the luminaire configuration of the present invention therefore involves, in particular, a simple tool-free attachment and detachment of the luminaire module to and from the mounting module without disturbing the illumination producing components. In the case where the luminaire configuration is provided with an electrical plug for establishing electrical connections, after the mounting module has been fastened on the securement base and an electrical junction line has been brought to the mounting module by an electrician and provided at its end with a female connector part, the luminaire module can now be mounted to the mounting module and its electrical plug plugged into the female connector part by inexperienced or untrained persons. Especially when equipping a building with a multiplicity of such luminaire configurations the mounting expenditures can be considerably reduced through this measure. In the case of equipping a building it can also first be undertaken to mount only the mounting modules and to place the electrical lines into the mounting modules. Providing such modular construction of the luminaire configuration permits any selected one of diverse luminaire modules to be attached to the same mounting module such that the selection of the proper luminaire configuration can take place subsequently at a later time. Correspondingly simplified by the luminaire configuration of the present invention is the replacement of one luminaire module by another. In the event that no luminaire module is to be mounted onto a mounting module in the near future, the mounting module can be concealed with a cover supporting the second connection element.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1*a* is a perspective view from below of a mounting module of one embodiment of a luminaire configuration of the present invention.

FIG. 1*b* is a perspective view from above of a coupling ring of a luminaire module of the same one embodiment of the luminaire configuration of the present invention.

DETAILED DESCRIPTION OF THE INVENTION

Figure 1C:
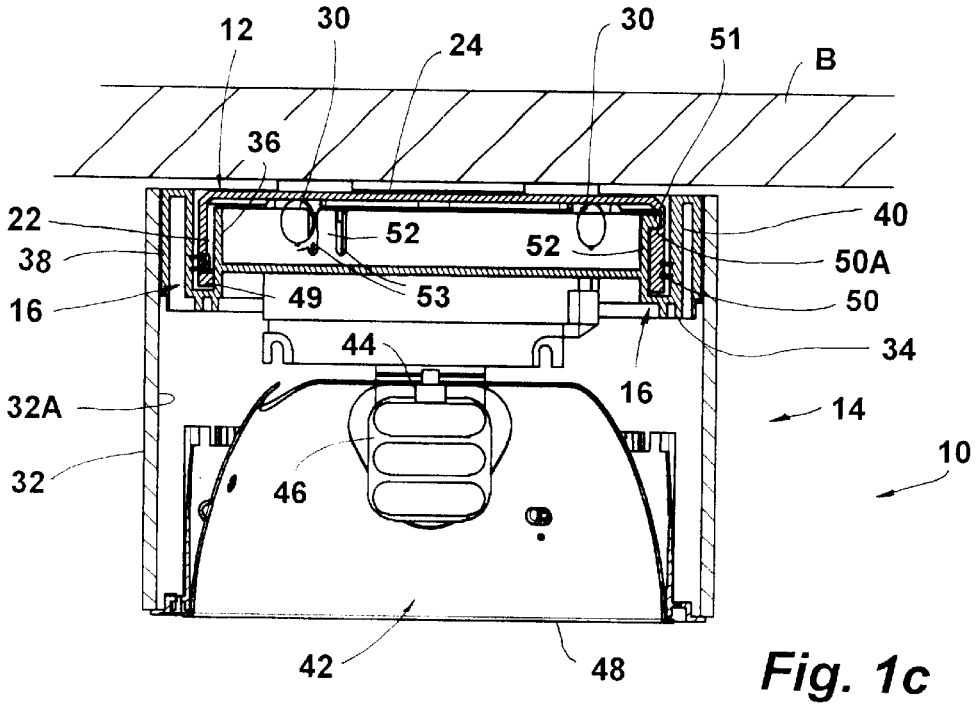
FIG. 1*c* is a longitudinal sectional view of the same one embodiment of the luminaire configuration shown mounted in a first mounting position on a securement base by mechanical cooperation of a first connection element on the mounting module of FIG. 1*a* with a second connection element on the coupling ring of FIG. 1*b*.

Referring to the drawings and particularly to FIGS. 1*a*–1*d*, there is schematically illustrated one embodiment of a luminaire configuration of the present invention, generally designated 10. The luminaire configuration 10 basically includes a mounting module 12 for attachment on a fastening or securement base B, such as a building ceiling or wall, a luminaire module 14 adapted to support illumination producing components, and a connection system 16 having first and second connection elements 18, 20 by which the luminaire module 14 is attachable to and detachable from the mounting module 12 through releasable mechanical cooperation between the first and second connection elements 18, 20.

Referring to FIGS. 1*a* and 1*c*, the mounting module 12 of the luminaire configuration 10 includes a ring segment 22 which at its rear side 22A is closed by a closure plate 24. The closure plate 24 has one or more fastening openings or apertures 26 defined therethrough which permit the mounting module 12 to be fastened in any suitable manner on the securement base B. Additionally, the closure plate 24 has a peg 28 or the like mounted thereon and projecting downwardly therefrom and provided with an opening 28A for fastening an electrical plug connection or a female connector part on the peg 28. Also, about the circumference of the ring segment 22 are disposed cable entries 30 through which electrical cables (not shown) can be led into or brought out from the mounting module 12. The cable entries 30 are closed with a film-like elastic material which can be opened readily by inserting a cable.

Referring to FIGS. 1*b* and 1*c*, the luminaire module 14 includes an outer luminaire housing 32 having an annular shape and a coupling ring 34 being generally S-shaped in cross-section and formed by an inner annular wall 36, an outer annular wall 38 and an intermediate wall 40 disposed and extending between opposite front and rear sides 34A, 34B of the coupling ring 34. At its outer annular wall 38, the coupling ring 34 is set in a torsionally tight relationship with an interior surface 32A of the luminaire housing 32 adjacent to a rear side 32B thereof so as to form an upper termination thereon. Within the outer luminaire housing 32 are supported the illumination producing components, for example, a reflector 42, a lamp socket 44, a lamp 46 and a front covering 48. Also, an electrical cable (not shown) connected to the lamp socket 44 and having a male electrical plug on its end can extend from the rear side 32B of the luminaire housing 32 for plugging into the female electrical socket part mounted on the closure plate 24 of the mounting module 12.

Figure 1D:
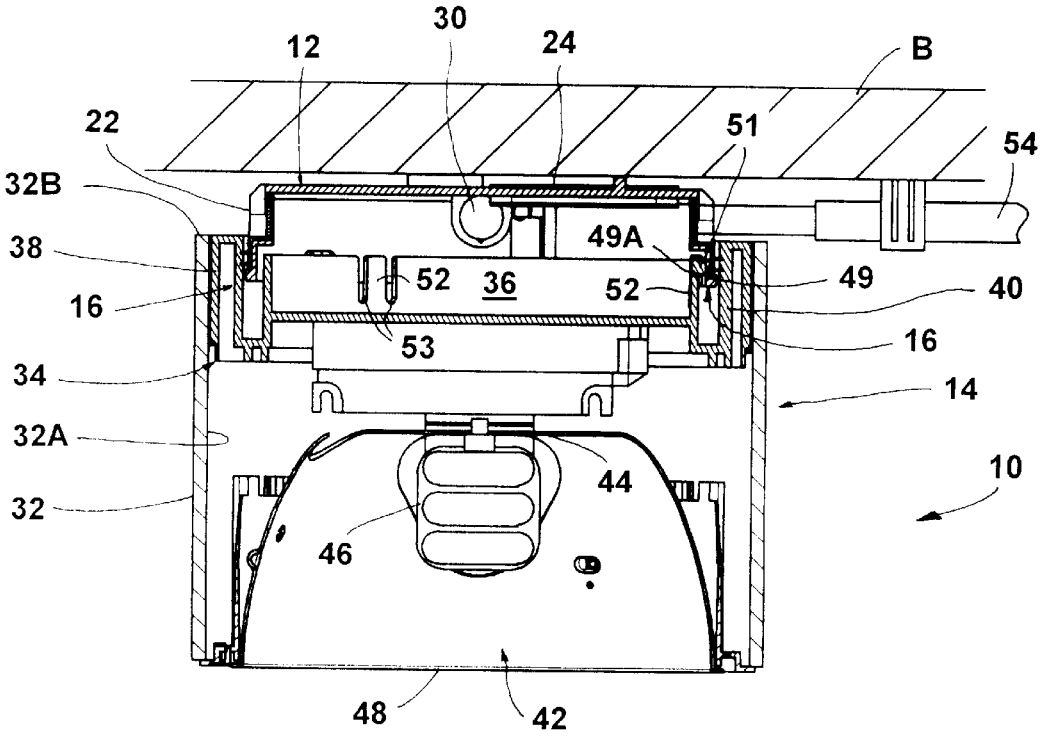
FIG. 1*d* is another longitudinal sectional view of the same one embodiment of the luminaire configuration shown mounted in a second mounting position on the securement base.

Referring to FIGS. 1*a*–1*c*, the first connection element 18 of the connection system 16 is provided on the mounting module 12 whereas the second connection element 20 of the connection system 16 is provided on the luminaire module 14 such that the luminaire module 14 is attachable to and detachable from the mounting module 12 through mechanical cooperation of the corresponding first and second connection elements 18, 20 to provide, for example, a bayonet-type closure. In particular, the first connection element 18 is a plurality of first and/or second bayonet snap contacts 49, 50 formed on and projecting radially inwardly from the ring segment 22 and alternating with one another and spaced circumferentially at substantially the same angular distance from one another about the ring segment 22. The difference between the first and second bayonet snap contacts 49, 50 is that the second snap contacts 50 are directed toward the closure plate 24 through a greater distance from the front side 22B of the ring segment 22 than are the first snap contacts 49. Thus, the first bayonet snap contacts 49 can be characterized as having short configurations located adjacent to the front side 22B of the ring segment 22 whereas the second bayonet snap contacts 50 can be characterized as having long configurations extending substantially between the rear and front sides 22A, 22B of the ring segment 22. The second connection element 20 is a plurality of bayonet snaps 51 each formed on one of a plurality of latching clips 52 made from the inner wall 36 of the coupling ring 34 of the luminaire module 14 by pairs of notches 53 defined in the inner wall 36. The bayonet snaps 51 are in the form of end protuberances on the latching clips 52 which project radially outwardly from the latching clips 52 toward the intermediate wall 40 of the coupling ring 34 and are configured to snap into interfitting engagement over or behind undercut ends 49A, 50A of selected ones of the short and long bayonet snap contacts 49, 50. Due to the elasticity of the material of the coupling ring 34, the latching clips 52 formed by the pairs of notches 53 are movable in the radial direction relative to the coupling ring 34. This movability is utilized in order to secure, after the coupling ring 34 has been mounted on the mounting module 12, the engagement of the bayonet snaps 51 with the undercut rear ends 49A or 50A of the bayonet snap contacts 49 or 50 as seen in FIGS. 1*c* or 1*d*. Thus, the luminaire module 14 is fastened to the mounting module 12 by capturing the bayonet snaps 51 formed on its coupling ring 34 in the positions seen in FIG. 1*c* or FIG. 1*d* where the latching clips 52 are disposed along the inner sides of the bayonet snap contacts 49, 50 with their bayonet snaps 51 in releasable latching positions over or behind the undercut rear ends 49A, 50A of the bayonet snap contacts 49, 50. The attachment and detachment of the luminaire module 14 to and from the mounting module 12 is effected via movement of the luminaire module 14 toward and away from the mounting module 12 with sufficient force as to engage and disengage the bayonet snaps 51 with and from the bayonet snap contacts 49, 50. Such attachment and detachment can be effected without the use of any tools being required.

Furthermore, due to the presence of the short and long configurations of the bayonet snap contact 49, 50 on the mounting module 12, the luminaire module 14 can be latched or fastened at two different mounting depths relative to the securement base B as is clear from a comparison of FIG. 1*c* with FIG. 1*d*. FIG. 1*c* shows the luminaire configuration 10 formed by the luminaire module 14 and the mounting module 12 in a first mounting position wherein the luminaire module 14 is disposed about flush with the securement base B, such as the building ceiling, the luminaire module 14 only being spaced from the underside of the ceiling surface by a small gap. FIG. 1*d* shows the luminaire module 14 in a modified mounting position wherein the luminaire module 14 is spaced from the underside of the ceiling surface by a gap sufficiently large as to permit a surface-mounted cable 54 to be exit laterally from the mounting module 12 between the rear side 32B of the outer luminaire housing 32 and the ceiling surface, for example, for connecting with adjacent luminaires. It will also be noted in FIG. 1*a* that a sealing ring 55 of annular configuration is disposed about the mounting module 12 so as to encircle the ring segment 22 at the outside thereof behind an outwardly radially protruding rim 22C on the front side 22B of the ring segment 22.

Figure 2:
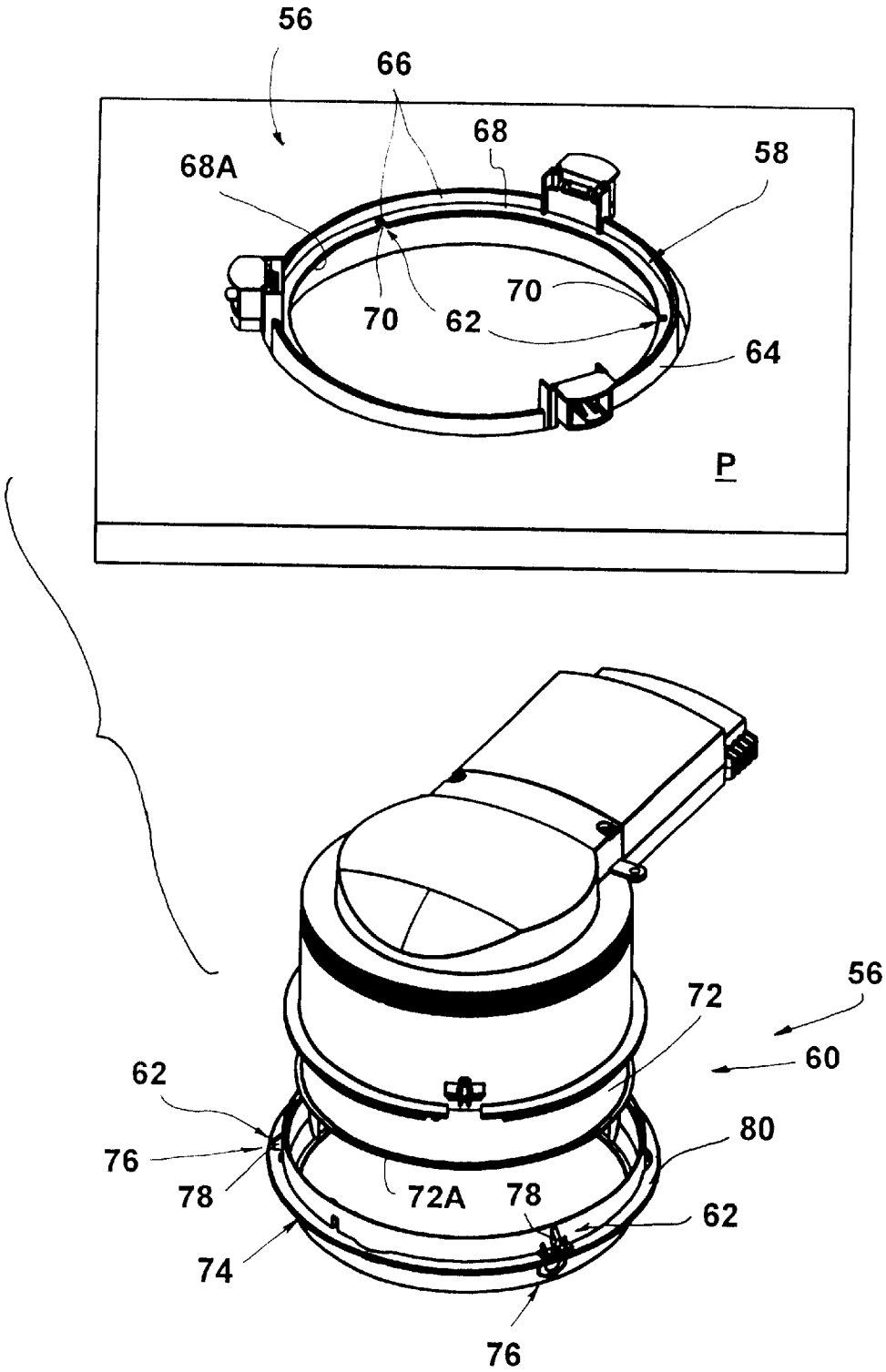
FIG. 2 is an exploded perspective view of another embodiment of a luminaire configuration of the present invention having a mounting module provided for installation in a ceiling panel.

Referring to FIG. 2, there is shown another embodiment of the luminaire configuration of the present invention, being generally designated 56. The luminaire configuration 56 has a mounting module 58, a luminaire module 60 and a connection system 62 for releasably attaching the luminaire module 60 to the mounting module 58. The mounting module 58 includes an adapter ring 64 set into an opening of a suspended ceiling panel P. The connection system 62 includes a first connection element 66 in the form an annular encircling flange 68 attached to and projecting inwardly from the adapter ring 64 and forming an undercut and a plurality of insertion slots or openings 70 defined in the flange 68 so as to extend into the flange 68 from an inner edge 68A thereof and being spaced from one another circumferentially at the same angular spacing about the flange 68. The luminaire module 60 includes a housing 72 for supporting the aforementioned illumination producing components and a coupling ring 74 adapted to tightly fitted about a front side 72A of the housing 72. The connection system 62 also includes a second connections element 76 in the form of a plurality of bayonet snaps 78 formed on the coupling ring 74 so as to project outwardly therefrom. The circumferential spacing of the snaps 78 on the coupling ring 74 is the same as that of the insertion openings 70 in the flange 68 and the inner widths of the insertion openings 70 corresponds substantially to the widths of the snaps 78 such that, upon insertion of the coupling ring 74 upwardly into the adapter ring 64 of the mounting module 58, the snaps 78 are inserted upwardly through the insertion openings 70 and, upon further slight rotation of the coupling ring 74 relative to the adapter ring 64, the snaps 78 are placed above and rest upon or behind the undercut formed by the flange 68 on the adapter ring 64. Spaced below the snaps 78 on the coupling ring 74 is provided an outer annular abutment flange 80 which limits the downward insertion depth of the luminaire module 60 to which the coupling ring 74 is fitted into the adapter ring 64 of the mounting module 58. When the abutment flange 80 of the luminaire module 60 and the encircling flange 68 of the mounting module 58 adjoin one another, the luminaire module 60 is rotated by a few angular degrees such that subsequently the snaps 78 rest with their undersides on the top side of or behind the encircling flange 68. Subsequently, the luminaire module 60 is secured on the mounting module 58. The circumferential disposition of the encircling flange 68 on the mounting module 58 permits adjustment into the desired position of the luminaire module 60 which is circular in cross section.

It can further be provided that the second connection element associated with the luminaire module 60 is part of a coupling ring 74 rotatably disposed on the luminaire module 60. With such an arrangement, the fastening of the luminaire module 60 on the mounting module 58 takes place by executing a corresponding rotational movement of the coupling ring 74 and the luminaire housing 72 does not need to be rotated. This arrangement is useful if on the luminaire module 60 is fastened, for example, a plug part and it is plugged for electrical connection of the luminaire module 60 into a female connector part fastened in the mounting module 58. In the event that the connection elements associated with the luminaire module 60 are fastened torsionally tight on the luminaire module 60, for establishing an electrical contact a so-called flying plug can be associated with the luminaire module 60.

Figure 3:
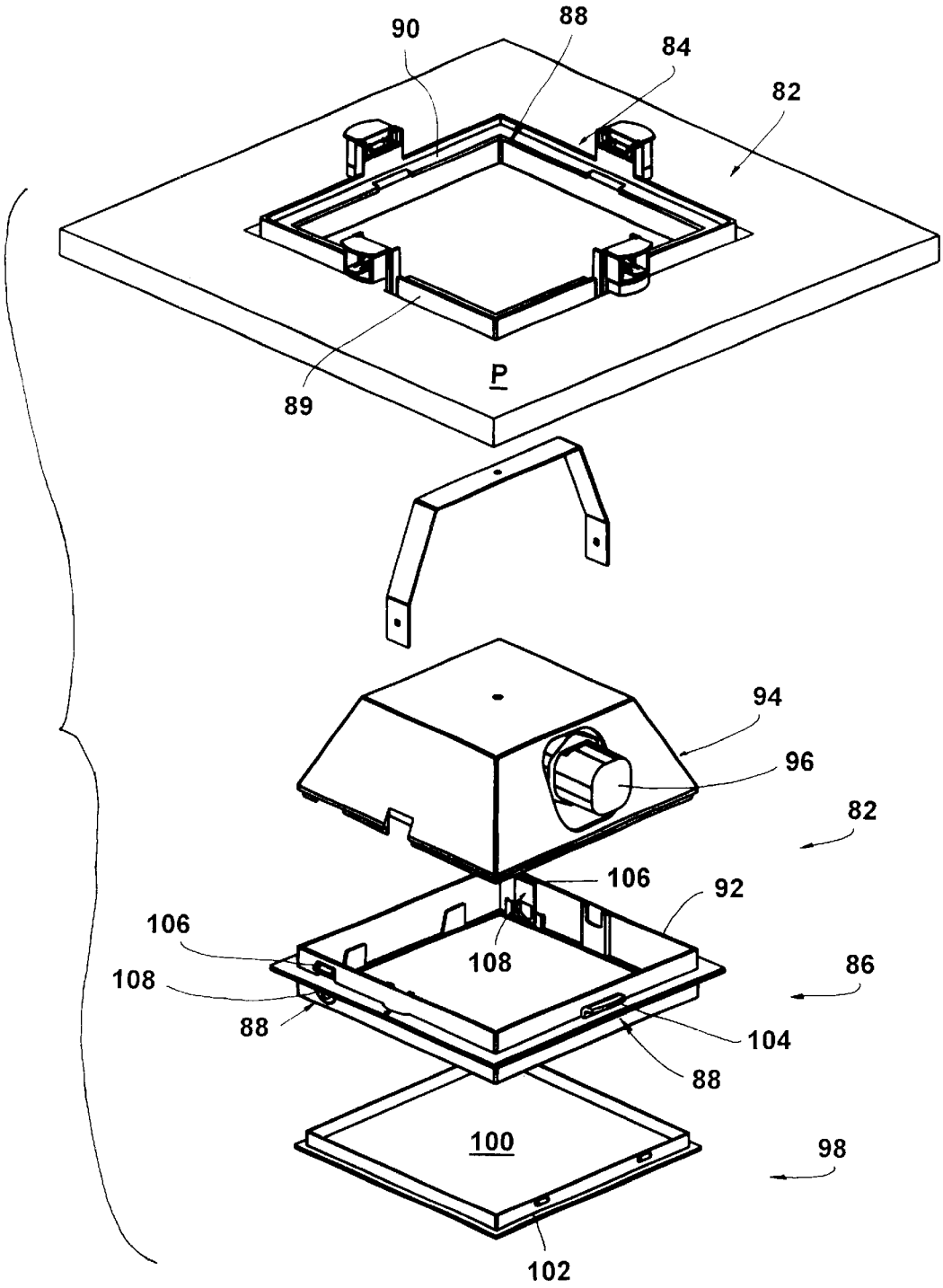
FIG. 3 is an exploded perspective view of yet another embodiment of a luminaire configuration of the present invention having a mounting module which can be set into a ceiling panel.

Referring to FIG. 3, there is shown yet another embodiment of the luminaire configuration of the present invention, being generally designated 82. The luminaire configuration 82 has a mounting module 84, a luminaire module 86 and a connection system 88 for releasably attaching the luminaire module 86 to the mounting module 84. The mounting module 84 is square in configuration and set into an opening of a suspended ceiling panel P. The mounting module 84 is in the form a flush-fitting ring 89. The connection system 88 includes a first connection element in the form of a flange 90 attached to and projecting inwardly from the ring 89 and forming an undercut. The luminaire module 86 also is square in configuration and includes a retaining ring 92 supporting the illumination producing components, namely, a reflector 94 at a top side thereof and to which is attached a lamp socket 96 and a covering 98 formed of a covering pane 100 and frame 102. The connection system 88 includes a second connection element in the form of a stationary suspension hook 104 and two bayonet latch snaps 106 on spaced portions of the retaining ring 92 which cooperate with the flange 90 of the mounting module 84. The bayonet latch snaps 106 form the upper ends of latching clips 108 formed from the material of the ring 89 such that the bayonet latch snaps 106 can be moved inwardly. The completely assembled luminaire configuration 82 is mounted by first placing the suspension hook 104 onto the top side of the flange 90 of the mounting module 84. The luminaire module 86 is subsequently swivelled or pivoted about the suspension hook 104 toward the mounting module 84 until the bayonet latch snaps 106 are placed above the flange 90. Due to the formation from an elastic material of the latching clips 108 which mount the bayonet latch snaps 106, such a latching takes place in the manner of a clipping action between the two modules 84, 86.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A luminaire configuration, comprising:

(a) a mounting module attachable on a securement base and having a ring segment of an annular shape;

(b) a luminaire module including a coupling ring of an annular shape adapted to interfit with said ring segment of said mounting module, said luminaire module also including a luminaire housing adapted to support illumination producing components, said luminaire housing having an end adapted to connectably fit with said coupling ring; and (c) a connection system having first and second connection elements respectively defined on one and the other of said ring segment of said mounting module and said coupling ring of said luminaire module such that said coupling ring of said luminaire module is attachable to and detachable from said ring segment of said mounting module through mechanical cooperation between said first and second connection elements without disturbing the illumination producing components supported by said luminaire housing of said luminaire module and by movement of said luminaire module relative to said mounting module that is effected without the use of any tools being required.

2. The luminaire configuration of claim 1 wherein said mechanical cooperation between said first and second connection elements is a releasable latch-type engagement therebetween.

3. The luminaire configuration of claim 2 wherein:

said first connection element is a plurality of bayonet snap contacts formed on said ring segment of said mounting module and having undercut ends; and said second connection element is a plurality of bayonet snaps formed on said coupling ring of said luminaire module and being yieldably movable radially thereof in response to engagement of said bayonet snaps with said bayonet snap contacts by movement of said luminaire module relative to said mounting module so as to place said bayonet snaps in a releasable latch-type engagement with said undercut ends of said snap contacts.

4. The luminaire configuration of claim 3 wherein said bayonet snap contacts include a first plurality of said snap contacts having a first length and a second plurality of said snap contacts having a second length greater than said first length such that when said bayonet snaps are engaged with said undercut ends of said snap contacts of said first plurality said luminaire module is disposed at a first position relative to said mounting module whereas when said bayonet snaps are engaged with said undercut ends of snap contacts of said second plurality said luminaire module is disposed at a second position relative to said mounting module that is different from said first position thereof.

5. The luminaire configuration of claim 2 wherein:

said first connection element is an undercut flange formed on and extending radially from said ring segment of said mounting module to an edge of said undercut flange and a plurality of insertion slots defined into said undercut flange from said edge thereof and being spaced circumferentially from one another; and said second connection element is a plurality of snaps formed on and protruding radially from said coupling ring of said luminaire module and being spaced circumferentially from one another corresponding to said circumferential spacing of said slots from one another such that by movement of said luminaire module toward said undercut flange on said mounting module said snaps are inserted through said slots and past said undercut flange and by rotational movement of said luminaire module relative to said undercut flange on said mounting module said snaps are displaced from said slots and placed behind said undercut flange in a releasable latch-type engagement therewith.

6. The luminaire configuration of claim 2 wherein:

said first connection element is an undercut flange formed on and extending radially from said ring segment of said mounting module to an edge of said undercut flange; and said second connection element is a plurality of snaps formed on said coupling ring of said luminaire module, said snaps including a stationary hook member and a pair of snap members spaced in opposite directions from said hook member and across said coupling ring of said luminaire module from one another such that by movement of said luminaire module toward said undercut flange on said ring segment of said mounting module said hook member is inserted behind said undercut flange on said ring segment and thereafter by pivotal movement of said luminaire module toward said undercut flange on said ring segment said snap members yieldably move radially of said luminaire module in response to engagement with said edge of said undercut flange and insert behind said undercut flange in a releasable latch-type engagement therewith.

* * * * *